US008602667B2

(12) United States Patent
Inoue

(10) Patent No.: US 8,602,667 B2
(45) Date of Patent: Dec. 10, 2013

(54) PRINTING DEVICE OPERATING IN A PLURALITY OF CONVEYANCE MODES

(75) Inventor: Yoshimasa Inoue, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 317 days.

(21) Appl. No.: 13/053,465

(22) Filed: Mar. 22, 2011

(65) Prior Publication Data

US 2012/0048077 A1 Mar. 1, 2012

(30) Foreign Application Priority Data

Sep. 1, 2010 (JP) ..... 2010-196027

(51) Int. Cl.
*B41J 29/38* (2006.01)
*B41J 11/46* (2006.01)
*B41J 11/70* (2006.01)

(52) U.S. Cl.
USPC ..... 400/76

(58) Field of Classification Search
USPC ..... 400/76, 621, 614, 614.1, 611
See application file for complete search history.

(56) References Cited

U.S. PATENT DOCUMENTS

| | | | | |
|---|---|---|---|---|
| 4,751,484 | A * | 6/1988 | Matsumoto et al. | 399/25 |
| 2006/0066703 | A1* | 3/2006 | Kadomatsu et al. | 347/102 |
| 2011/0012979 | A1* | 1/2011 | Kitamura | 347/218 |
| 2012/0224907 | A1* | 9/2012 | Serizawa et al. | 400/621 |

FOREIGN PATENT DOCUMENTS

| | | | | |
|---|---|---|---|---|
| JP | 07251539 | A * | 10/1995 | B41J 11/70 |
| JP | 2007-038557 | | 2/2007 | |
| JP | 2007-203626 | | 8/2007 | |
| JP | 2009220427 | A * | 10/2009 | B41J 11/42 |

* cited by examiner

*Primary Examiner* — Daniel J Colilla
(74) *Attorney, Agent, or Firm* — Turocy & Watson, LLP

(57) ABSTRACT

According to one embodiment, a printing device includes a conveyance mechanism configured to convey a printing medium along a conveying path, and a detection device provided on the conveying path and configured to detect a position of the printing medium therealong. The printing device further includes a control device configured to select one of first and second conveyance modes in response to a predetermined condition, the control device being further configured to control the conveyance mechanism so as to convey the printing medium along the conveying path based on the selected conveyance mode. In the second conveyance mode, the printing medium is conveyed along the conveying path while being detected by the detection device, at a conveyance speed slower than that of the first conveyance mode.

19 Claims, 6 Drawing Sheets

PRINTING DEVICE OPERATING IN A PLURALITY OF CONVEYANCE MODES

CROSS-REFERENCE TO RELATED APPLICATIONS

This application is based upon and claims the benefit of priority from Japanese Patent Application No. 2010-196027, filed on Sep. 1, 2010, the entire contents of which are incorporated herein by reference.

FIELD

Embodiments described herein relate generally to a printing device and a paper conveyance method for used in the printing device, employing a plurality of conveyance modes for printing media.

BACKGROUND

In the related art, printing devices have been manufactured and used in printing information or data on a printing medium (e.g., a paper) and cutting a printed portion from the printing medium to issue as a receipt. Such a printing device may be employed as a receipt printing device, for example, in an ATM (Automatic Teller Machine), where a paper roll is provided to be cut by a predetermined length adapted for a respective receipt. The cut portion of the rolled paper may be printed with required information to be issued as a receipt.

For example, a sensor may be employed to detect a head position (or a printable area spaced apart from a leading edge) of a printing medium remaining after a printed portion from the printing medium is cut. In such a configuration, since the sensor keeps scanning the printing medium while it is being conveyed, deceleration of a conveyance speed may be necessary in order to accurately detect the head position of the printing medium.

In conventional printing devices, where a sensor is employed to detect a head position of a printing medium remaining after a printed portion from the printing medium is cut, conveyance speed may need to be decelerated for the sensor to accurately detect the head position of the printing medium while it is being conveyed. This results in low throughput in printing.

DETAILED DESCRIPTION

According to one embodiment, a printing device includes a conveyance mechanism configured to convey a printing medium along a conveying path, and a detection device provided on the conveying path and configured to detect a position of the printing medium therealong. The printing device further includes a control device configured to select one of first and second conveyance modes in response to a predetermined condition, the control device being further configured to control the conveyance mechanism so as to convey the printing medium along the conveying path based on the selected conveyance mode. In the second conveyance mode, the printing medium is conveyed along the conveying path while being detected by the detection device, at a conveyance speed slower than that of the first conveyance mode.

Figure 1:
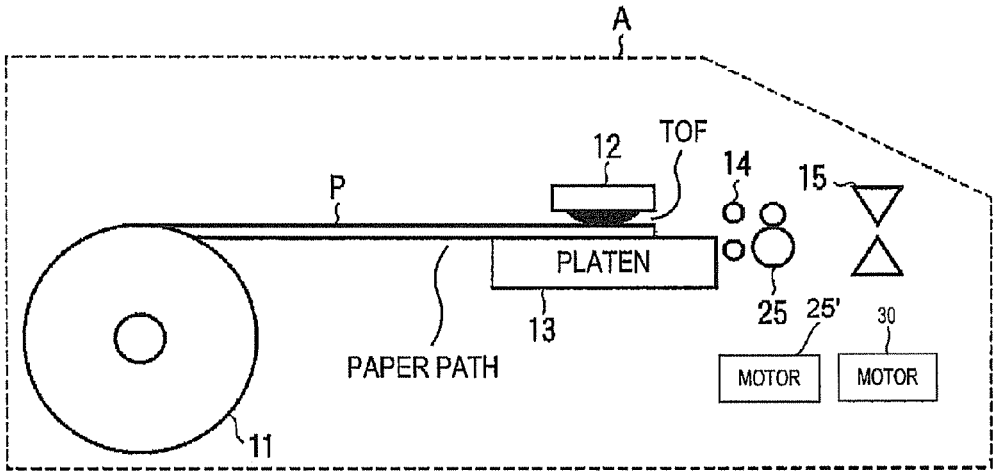
FIG. 1 is a side elevational showing a state in which a paper is located at a TOF (Top of Form) position in a printing device according to an illustrative embodiment.

Embodiments will now be described in detail with reference to the drawings. As shown in FIG. 1, a printing device A according to one embodiment includes a paper roll 11, a photosensor (e.g., a reflective photosensor) 14 configured to detect a paper P which is discharged from the paper roll 11 and being conveyed along a conveying path (e.g. paper path), a conveyance roller 25 that is driven by a motor (e.g., a step motor) 25 configured to convey the paper P along the conveying path, a thermal head 12 configured to print information on the paper P, and a print platen 13 provided to face the thermal head 12. The printing device A further includes a cutter 15 configured to cut the paper P at a cut position, and a cutter motor 30 configured to drive the cutter 15 (see FIG. 5).

Figure 5:
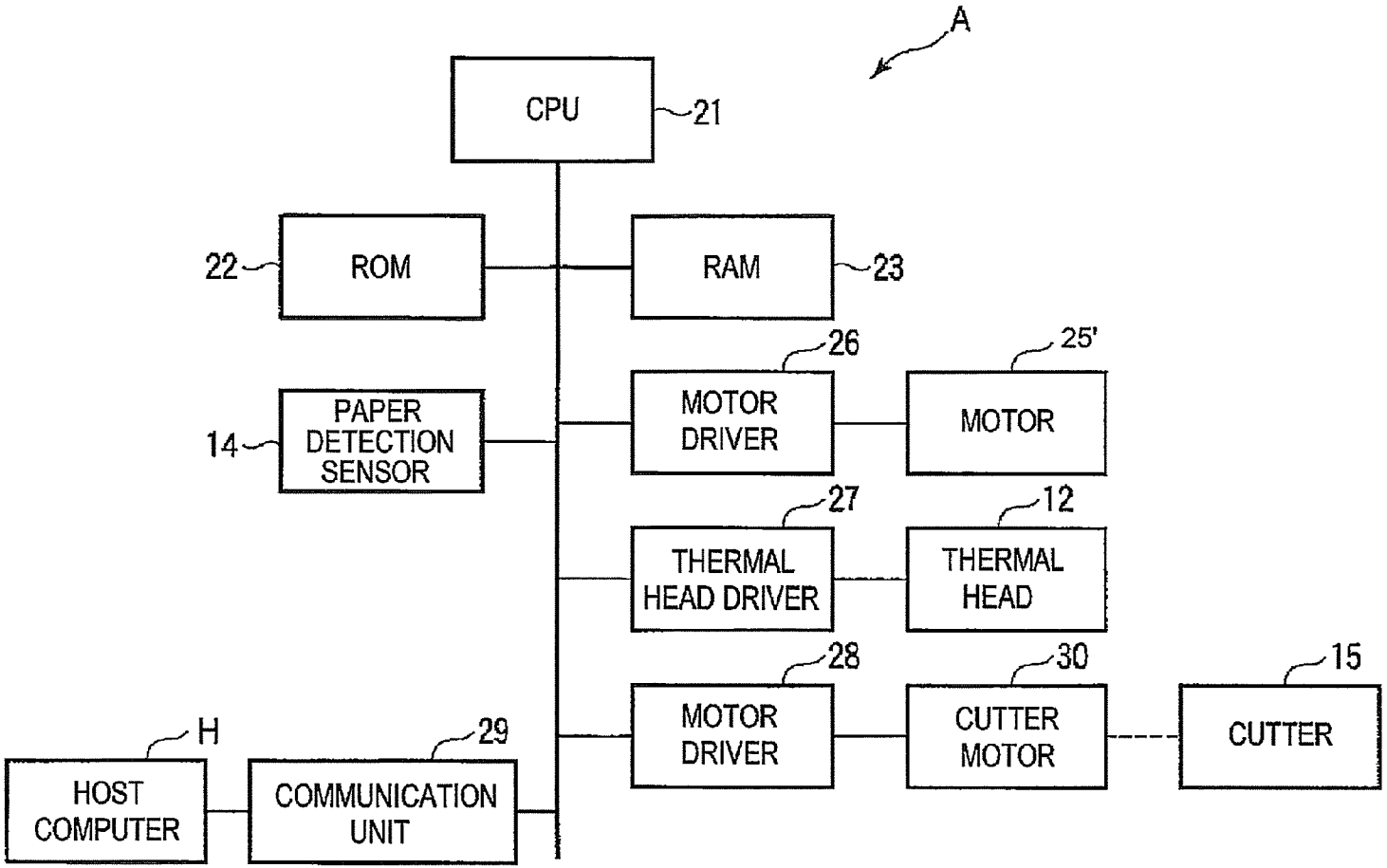
FIG. 5 is a block diagram showing an example of an electrical configuration of a printing device according to an illustrative embodiment.

Further, as shown in FIG. 5, the printing device A according to one embodiment includes a central processing unit (CPU) 21 configured to control the entire operation of the printing device A, a read only memory (ROM) 22 to store operation programs therein, and a random access memory (RAM) 23 to store operation programs or control information therein. The printing device A further includes a motor driver 26 configured to drive the motor 25', a thermal head driver 27 configured to drive the thermal head 12, a motor driver 28 configured to drive the cutter motor 30, and the photosensor 14. The printing device A further includes a communication unit 29 configured to enable communication with an external host computer H through a network. These components may be connected to each other via a bus 20*m*.

Figure 6:
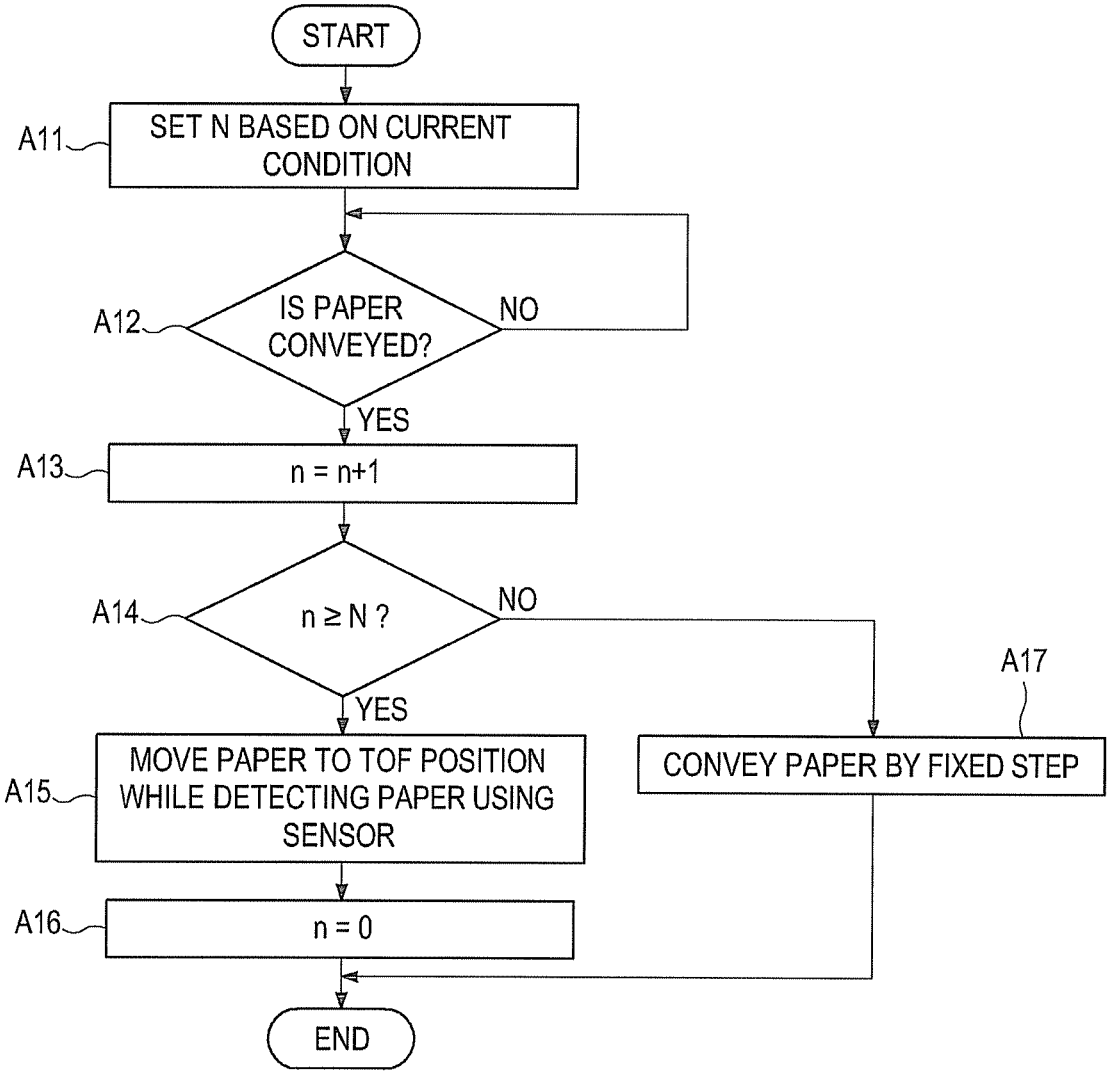
FIG. 6 is a flow chart showing an example of a conveying process in a printing device according to an illustrative embodiment.

In the following, a conveying process of the printing device A will be described with the above-described configuration, as shown in FIG. 6. In the printing device A according to one embodiment, a plurality of conveyance modes may be employed to meet different conditions of the printing device A. Each of the plurality of conveyance modes may be selected so that the conveying process is performed based on the selected conveyance mode with a predetermined frequency. In one embodiment, the plurality of conveyance modes may include two modes as described below.

In a second conveyance mode, a printing medium (e.g., the paper P) is conveyed from a cut position to a TOF (Top of Form) position while being scanned by a sensor (e.g., the photosensor 14) (conveying speed: LOW). In a first conveyance mode, the printing medium is conveyed from the cut position to the TOF position by driving the motor 25" by a fixed step number (conveying speed: HIGH). The TOF position represents a position where the thermal head 12 can stably print data on the paper P, for example, the position of the paper P as shown in FIG. 1. In one embodiment, the TOF position may be defined based on a head position that is spaced apart from a leading edge of the paper P by, for example, several millimeters. Printing can be performed starting from the head position.

Specifically, as shown in FIG. 6, the CPU 21 sets a constant number N (where N is an integer) to be used in switching between the first and second conveyance modes (Act A11). In one embodiment, N may be set to be a certain value (e.g, a value of 10), depending on a current condition (e.g., remaining lifetime) of the printing device A. In other words, if the printing device A has been just shipped from a factory, a conveying system of the printing device A may be performed precisely with little error. Accordingly, the constant number N may be initially set to be a relatively high value so that the frequency of usage of the first conveyance mode is increased, thereby improving the entire throughput of the printing device A. Thereafter, with an increase in the usage of the printing device A, the constant number N may be set to be a relatively low value so that the frequency of usage of the second conveyance mode is increased. This complements and compensates for the precision reduction of the printing device A as it is used more frequently.

Figure 2:
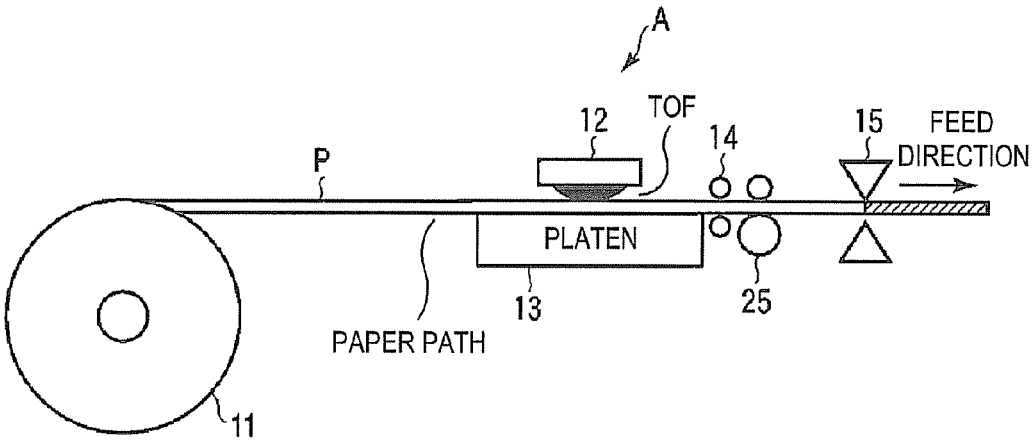
FIG. 2 is a side elevational view showing a state in which a paper is located at a cut position in the printing device.
Figure 3:
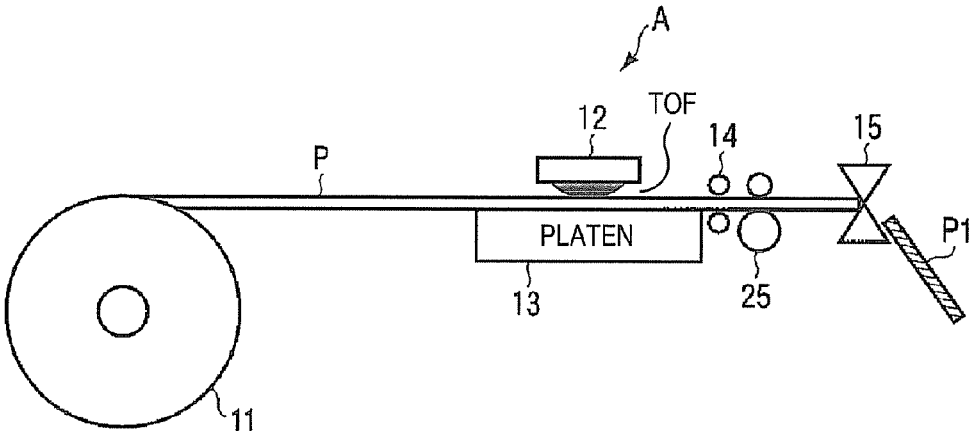
FIG. 3 is a side elevational view showing a state in which a paper is cut in the printing device.
Figure 4:
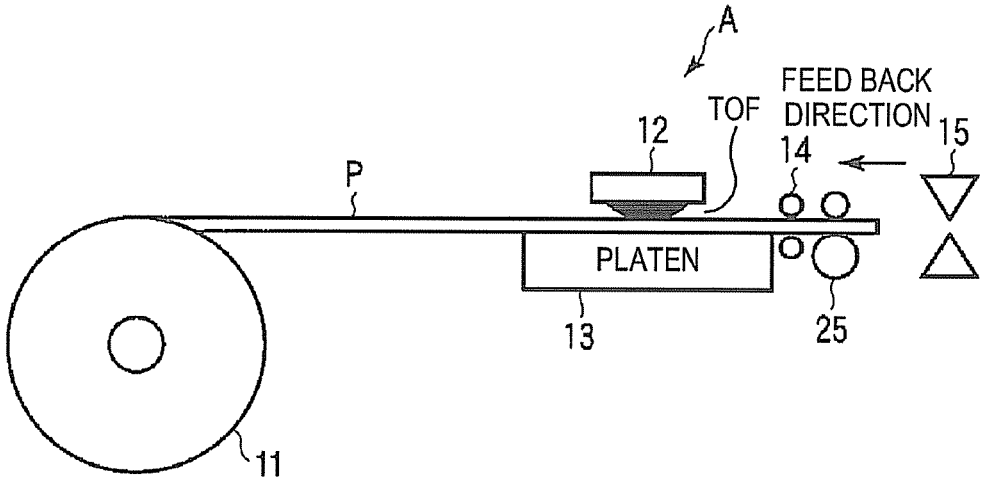
FIG. 4 is a side elevational view showing a state in which a paper is being returned to the TOF position in the printing device.

Initially, as shown in FIG. 1, a leading edge of the paper P is conveyed to the TOF position where the paper P is to be printed with given information by the thermal head 12. Thereafter, as shown in FIGS. 2 and 3, the paper P is conveyed to a cut position, at which a paper P1 can be stably cut, in a feed direction, and then is cut by the cutter 15 at the cut position. Subsequently, as shown in FIG. 4, the paper P is positioned (fed back) to the TOF position in a feed back direction (opposite the feed direction), where the paper P is ready for subsequent printing. At Act A12, the CPU 21 determines whether the paper P is conveyed to the TOF position where the thermal head 12 is located, after the cutting.

If the CPU 21 determines that the paper P is conveyed to the TOF position, a (variable) value n is incremented by one (Act A13). In one embodiment, the value n is initially set to be zero and updated/stored in a rewritable memory (e.g., the RAM 23). Then, the CPU 21 determines whether the value n reaches N (Act A14). If the determination result is NO at Act A14, the process proceeds to Act A17, where the conveyance of the paper P is performed in the first conveyance mode. In the first conveyance mode, the paper P is conveyed from the cut position to the TOF position by driving the motor 25 by a predetermined step number. A conveying speed of the first conveyance mode is higher than that of the second conveyance mode. Thus, as shown in FIG. 1, the paper P reaches the TOF position.

On the other hand, at Act A14, the CPU 21 determines that the value n reaches N, the second conveyance mode is selected. In the second conveyance mode, the paper P is conveyed from the cut position to the TOF position while being detected by the photosensor 14 (Act A15). In this case, a conveying speed of the second conveyance mode is lower than that of the first conveyance mode. In general, since a head position is gradually deviated from the right position (e.g., the TOF position) due to various factors (for example, a slippage of paper on a conveyance roller, backlash, etc.), the conveyance by the motor in the predetermined step number according to the first conveyance mode may fail to accurately position the paper at the TOF position. Therefore, as described above, the photosensor 14 may be used once in several times to correctly detect the head position of the paper P being conveyed along the paper path.

In the printing device A according to the above embodiment, the two types of conveyance modes (e.g., the first and second conveyance modes) are employed at a predetermined frequency (e.g., one in N times). This prevents deterioration in throughput and also reduces a detection error of the head position. In one embodiment, the selection of the conveyance mode is made so that (usage frequency of the first conveyance mode) (usage frequency of the second conveyance mode) to avoid degradation in throughput.

Figure 7:
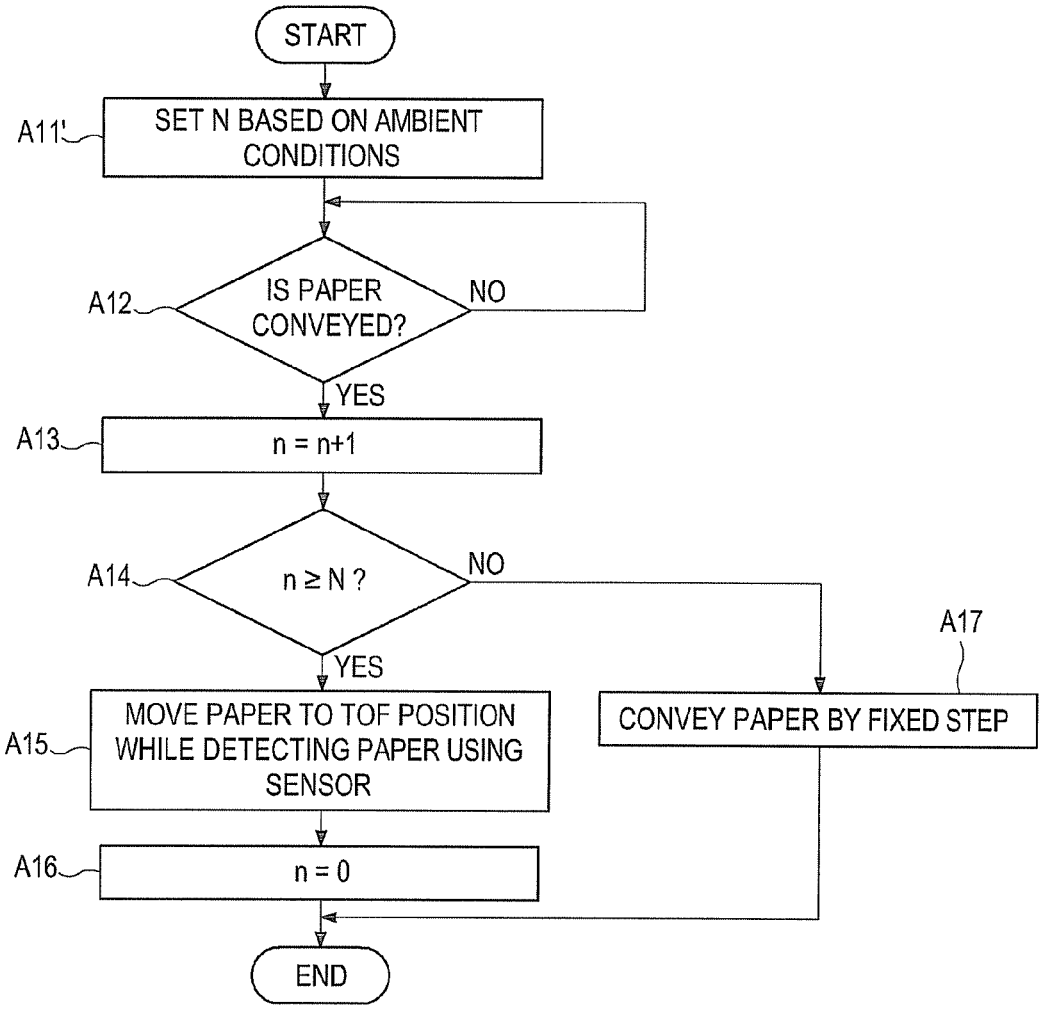
FIG. 7 is a flow chart showing an example of a conveying process in a printing device according to another illustrative embodiment.

In the above embodiment, the constant number N is set based on the remaining lifetime and the usage frequency of the printing device A, but may not be limited thereto. For example, in an alternative embodiment, as shown in Act A11' in FIG. 7, the constant number N may be set based on ambient conditions (e.g., humidity, temperature, etc.) in which the printing device is placed. In FIG. 7, the same reference numerals as used in FIG. 6 refer to the same acts and thus descriptions thereof will not be repeated. For example, an abnormal condition (e.g., a high ambient humidity, a high ambient temperature, etc.) may cause the paper slippage on conveyance rollers provided in the printing device or backlash. Accordingly, the constant number N may be set in consideration of the ambient conditions (e.g., humidity, temperature, etc.). In the present embodiment, the constant number N is set based on the ambient humidity and the ambient temperature, but not limited thereto. In another embodiment, the constant number N may be set based on other ambient conditions.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing device comprising:

a conveyance mechanism configured to convey a printing medium along a conveying path;

a detection device provided on the conveying path and configured to detect a position of the printing medium therealong; and a control device configured to select one of first and second conveyance modes in response to a predetermined condition, the control device being further configured to control the conveyance mechanism so as to convey the printing medium along the conveying path based on the selected conveyance mode, wherein, in the first conveyance mode, the printing medium is conveyed along the conveying path without using the detection device, and, in the second conveyance mode, the printing medium is conveyed along the conveying path while being detected by the detection device, at a conveyance speed slower than that of the first conveyance mode.

2. The device of claim 1, further comprising:

a print mechanism provided on the conveying path and configured to print information on the printing medium; and a cutter mechanism provided on the conveying path and configured to cut a printed portion from the printing medium when the printing medium is disposed at a cut position, wherein the control device controls the conveyance mechanism to position the printing medium from the cut position to a position on the conveying path where subsequent printing is performed based on the selected conveyance mode.

3. The device of claim 1, wherein the control device is configured to select one of the first and second conveyance modes so that the usage frequency of the first conveyance mode is higher than that of the second conveyance mode.

4. The device of claim 1, wherein in the first conveyance mode, the control device is configured to control the conveyance mechanism so as to position the printing medium from the cut position along the conveying path by a predetermined step number.

5. The device of claim 4, wherein the conveyance mechanism is a step motor.

6. The device of claim 1, wherein the control device selects the second conveyance mode once in N times of conveying the printing medium, wherein N is an integer determined based on the predetermined condition.

7. The device of claim 6, wherein the predetermined condition for determining N includes the remaining lifetime of the printing device.

8. The device of claim 6, wherein the predetermined condition for determining N includes the usage frequency of the printing device.

9. The device of claim 6, wherein the predetermined condition for determining N includes at least one of ambient humidity and temperature where the printing device is placed.

10. The device of claim 6, wherein N is 10.

11. The device of claim 1, wherein the predetermined condition includes at least one of a remaining lifetime and a usage frequency of the printing device.

12. The device of claim 1, wherein the predetermined condition includes at least one of an ambient humidity and an ambient temperature where the printing device is placed.

13. A method of conveying a printing medium along a conveying path in a printing device, the method comprising:

selecting one of first and second conveyance modes in response to a predetermined condition, wherein, in the first conveyance mode, the printing medium is conveyed along the conveying path without using a detection device, and, in the second conveyance mode, the printing medium is conveyed along the conveying path while being detected by the detection device, at a conveyance speed slower than that of the first conveyance mode; and controlling a conveyance mechanism so as to convey the printing medium along the conveying path based on the selected conveyance mode.

14. The method of claim 13, further comprising:

cutting, by a cutting mechanism, a printed portion from the printing medium when the printing medium is disposed at a cut position; and controlling the conveyance mechanism to position the printing medium to a printable position based on the selected conveyance mode.

15. The method of claim 13, wherein if the selected conveyance mode is the first conveyance mode, the controlling includes controlling the conveyance mechanism to position the printing medium from the cut position along the conveying path by a predetermined step number.

16. The method of claim 13, wherein the selecting is performed so that the second conveyance mode is selected once in N times, wherein N is an integer.

17. The method of claim 13, wherein the predetermined condition includes at least one of a remaining lifetime and a usage frequency of the printing device.

18. The method of claim 13, wherein the predetermined condition includes at least one of an ambient humidity and an ambient temperature where the printing device is placed.

19. The method of claim 13, wherein the printing medium is paper wound in a roll shape and is loaded within the printing device.

* * * * *